US008047142B2

(12) United States Patent
Villiger

(10) Patent No.: US 8,047,142 B2
(45) Date of Patent: Nov. 1, 2011

(54) PROTECTION METHOD AND PROTECTION SYSTEM FOR VALUABLES

(76) Inventor: Peter Villiger, Beinwil (CH)

( * ) Notice: Subject to any disclaimer, the term of this patent is extended or adjusted under 35 U.S.C. 154(b) by 478 days.

(21) Appl. No.: 11/724,955

(22) Filed: Mar. 16, 2007

(65) Prior Publication Data

US 2007/0251431 A1 Nov. 1, 2007

(30) Foreign Application Priority Data

Mar. 17, 2006 (CH) ..... 420/06

(51) Int. Cl.
*E05G 1/00* (2006.01)

(52) U.S. Cl. ..... 109/25; 109/29; 109/31; 109/32

(58) Field of Classification Search ..... 109/20, 109/25–34, 61–63, 36–44, 53, 57
See application file for complete search history.

(56) References Cited

U.S. PATENT DOCUMENTS

| | | | | | |
|---|---|---|---|---|---|
| 1,936,385 | A * | 11/1933 | Dilatush | 109/25 |
| 3,990,063 | A * | 11/1976 | Schuman | 340/544 |
| 4,224,861 | A * | 9/1980 | Sands | 454/229 |
| 4,391,203 | A | 7/1983 | Millar | |
| 4,523,528 | A * | 6/1985 | Hastings et al. | 109/42 |
| 4,607,579 | A * | 8/1986 | Stenild | 109/25 |
| 4,799,435 | A * | 1/1989 | Boutroy | 109/25 |
| 4,942,831 | A * | 7/1990 | Tel | 109/29 |
| 5,796,330 | A * | 8/1998 | Vinette | 340/426.26 |
| 6,568,336 | B2 * | 5/2003 | Van Lint | 109/29 |
| 7,395,766 | B2 * | 7/2008 | Landwehr et al. | 109/25 |

FOREIGN PATENT DOCUMENTS

| | | |
|---|---|---|
| CH | 200500907/05 | 5/2005 |
| WO | PCT/EP2006/050742 | 8/2006 |

* cited by examiner

*Primary Examiner* — Lloyd Gall
(74) *Attorney, Agent, or Firm* — McCarter & English, LLP

(57) ABSTRACT

There is provided a protection method and protection system for valuables. An internal enclosure for enclosing the valuables, an external enclosure for enclosing the internal enclosure, a misuse protection device for the valuables, and a triggering device for triggering the misuse protection device in the event of an unauthorized manipulation of the external enclosure are provided. The external enclosure is closable to form a seal. A pressure chamber, which is impinged by an initial pressure, is produced in the external enclosure. A setpoint pressure is generated, which deviates from the ambient pressure, in the pressure chamber when the external enclosure is closed to form a seal. A pressure sensor is used for detecting the pressure in the pressure chamber. The pressure sensor controls initialization of the triggering device. The triggering device triggers the misuse protection device when the pressure deviates by more than a tolerance pressure value from the setpoint pressure.

32 Claims, 3 Drawing Sheets

PROTECTION METHOD AND PROTECTION SYSTEM FOR VALUABLES

CROSS-REFERENCE TO RELATED APPLICATIONS

This application claims priority to Swiss Application No. CH 00420/06, filed Mar. 17, 2006, the contents of which are expressly incorporated by reference in their entirety as part of the present disclosure.

BACKGROUND

1. Field of the Invention

The present invention relates to a protection system for valuables including an internal enclosure for enclosing the valuables, an external enclosure for enclosing the internal enclosure, and a misuse protection device for the valuables, and an associated protection method.

2. Description of the Related Art

Valuables, in particular currency, must be protected continuously, i.e., during their storage and during transport. The valuables are typically enclosed in internal enclosures in the form of cassettes, as described, for example, in Swiss Patent Application 2005 00907/05. However, cases according to International Patent Application PCT/EP2006/050742 may also be used.

The term "enclosed" is not necessarily to be understood to mean that the internal enclosures and also the external enclosures cited below are lockable using mechanical, key-operated locks in the typical sense; the internal enclosures and the external enclosures may also be secured against opening in a closed and/or fastened form in another suitable way, in such a way that the valuables are encapsulated in a type of capsule whose interior is only accessible by suitable manipulations.

Such cassettes are usually stored in security devices during the storage of the valuables, for example, in a cash center or in a bank. Preferably, vehicles whose cargo spaces contain security devices for the cassettes are also used during transport using vehicles.

The danger of theft for the cassettes is especially high during transport between vehicles and buildings or on longer transport routes within building complexes. In order to protect the valuables and/or the internal enclosures and/or cassettes in this case, they are enclosed in special external enclosures, and a misuse protection device is provided, which is triggered in the event of unauthorized manipulations of the external enclosure. The misuse protection device may be situated in or on the internal enclosure and implemented for the purpose, for example, of marking and/or devaluing the valuables in such a way that they may not be misused. The misuse protection device may also comprise other measures such as an acoustic or visual warning signal, which may be detected on location or in a central office by monitoring personnel.

The external enclosures used up to this point and in particular their security units are complex to produce and are generally only capable of receiving cassettes having specific dimensions and a specific embodiment.

In particular, the outlay for mechanically protecting cassettes or transport cases against unauthorized access is becoming greater and greater. The cases are thus also becoming heavier and heavier and more and more expensive. The electronics used up to this point are also becoming more and more complex and thus also more complicated to handle.

SUMMARY

It is therefore the object of the present invention to suggest a protection method for protecting valuables of the type cited at the beginning, using which high security may be ensured and the disadvantages of known protection systems may be avoided simultaneously, and to provide a protection system for protecting valuables of the type cited at beginning, which is simple to produce and use with high security.

This object is achieved by a protection system and method for protecting valuables, the valuables being enclosed in an internal enclosure, the internal enclosure being enclosed in an external enclosure, and a misuse protection device for the valuables being triggered in the event of an unauthorized manipulation on the external enclosure. The method includes the steps of: enclosing the internal enclosure in the external enclosure, and forming a tightly sealed pressure chamber impinged by an initial pressure in the external enclosure; using pressure-changing means, generating a setpoint pressure, which deviates from the ambient pressure, in the pressure chamber; monitoring the pressure in the pressure chamber using a pressure sensor; and triggering the misuse protection device via triggering means, which are controlled by the pressure sensor, when the pressure in the pressure chamber deviates from the setpoint pressure by more than a tolerance pressure value.

A protection system for protecting valuables includes an internal enclosure for enclosing the valuables, an external enclosure for enclosing the internal enclosure, and a misuse protection device for the valuables. The external enclosure is closable to form a seal and a pressure chamber impinged by an initial pressure may thus be generated in the external enclosure. The system also includes a triggering device for triggering the misuse protection device in the event of an unauthorized manipulation of the external enclosure, pressure-changing means, to generate a setpoint pressure, which deviates from the ambient pressure, in the pressure chamber when the external enclosure is closed to form a seal, a pressure sensor situated to detect the pressure in the pressure chamber, and initialization means controllable by the pressure sensor, by which the triggering device may be initialized and thus the misuse protection device may be triggered when the pressure deviates from the setpoint pressure by more than a tolerance pressure value.

Preferred refinements of the protection method according to the present invention and the protection system according to the present invention are defined by the particular dependent claims.

According to the present invention, an external enclosure is used which is closable gas-tight. A pressure chamber is thus formed between the internal enclosure and the external enclosure, which is impinged by an initial pressure after the external enclosure is closed. This initial pressure typically differs only slightly or not at all from the ambient pressure. A setpoint pressure is now generated in the pressure chamber, which deviates from the ambient pressure, i.e., it is above or below the ambient pressure. The pressure in the pressure chamber is monitored using a pressure sensor. The misuse protection device is triggered starting from the pressure sensor as soon as the pressure in the pressure chamber deviates from the setpoint pressure by more than a tolerance pressure value.

Means are provided to change the state of the misuse protection device between an idle state and a triggerable state. The misuse protection device is put in the triggerable state, preferably after the setpoint pressure is reached in the pressure chamber, and it is put back into the idle state when the external enclosure is to be opened by a person authorized for this purpose.

The setpoint pressure may be generated with the aid of a pump, for example, for which an opening is provided in the external enclosure, through which air passes during the pumping procedure, and which is closable to form a seal as soon as the pump has increased or decreased the pressure in the pressure chamber to the setpoint pressure. Such a change of the pressure is referred to as a change with external air communication.

The setpoint pressure may also be generated without external air communication, controlled internally but possibly externally, by a physical and/or chemical procedure.

A physical procedure for generating the setpoint pressure may play out in such a way that a chronologically controllable physical procedure is executed. An opening in the external enclosure, as is necessary in the event of the use of a pump described above and which may form a weak point, is unnecessary for this purpose. A setpoint pressure which is above the initial pressure may be generated by an expansion of a fluid in gaseous form from a pressure container into the pressure chamber. In this case, a setpoint pressure is preferably selected which lies above the ambient and/or initial pressure. A setpoint pressure which lies below the initial pressure may be generated by pumping air out of the pressure chamber via a check valve into a pressure container situated in the pressure chamber.

Another possibility for generating the setpoint pressure is to generate a chronologically controllable chemical procedure, such as a pyrotechnic procedure in the pressure chamber.

To increase the protection and to take changes of the ambient pressure into consideration, which may occur as a result of changes of the air pressure and/or the temperature and/or the altitude, it is advantageous if the setpoint pressure is changeable.

In addition, it advantageously increases the protection if the setpoint pressure is chronologically selectable or changeable according to a random principle.

As already noted, the internal enclosure is typically a cassette, such as a currency cassette, and it typically comprises the misuse protection device.

The misuse protection device may, for example, be a device connected to the internal enclosure for devaluing the valuables, for example, using a staining or etching material.

It is especially advantageous to use a rigid external enclosure, for example, an external enclosure like a hardside case. The essential advantages of this are that such hardside cases are cost-effective, and a specific hardside case may be used as the external enclosure for internal enclosures of various types and dimensions.

The external enclosure may have an internal and an external wall, the pressure chamber being formed between these two walls. This has the advantage that the pressure chamber has a smaller volume, so that generating the setpoint pressure requires less effort.

BRIEF DESCRIPTION OF THE DRAWINGS

Further properties and advantages of the present invention are described in the following on the basis of an exemplary embodiment and with reference to the drawing.

The figures are simplified and schematic and are not to scale. Identical and similar and/or identically or similarly acting components are identified in all figures with identical reference signs, but are not described with reference to each figure to avoid repetition. Specifications such as "top", "bottom", "left", and "right" relate to the position of the elements in the particular figures.

DETAILED DESCRIPTION

Figure 1A:
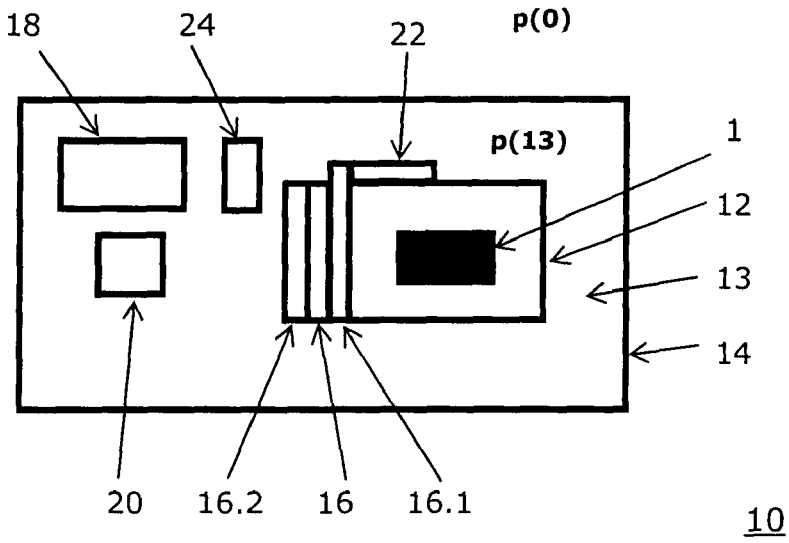
FIG. 1A shows a first exemplary embodiment of the present invention, having an internally situated controller, in a greatly simplified illustration.
Figure 1B:
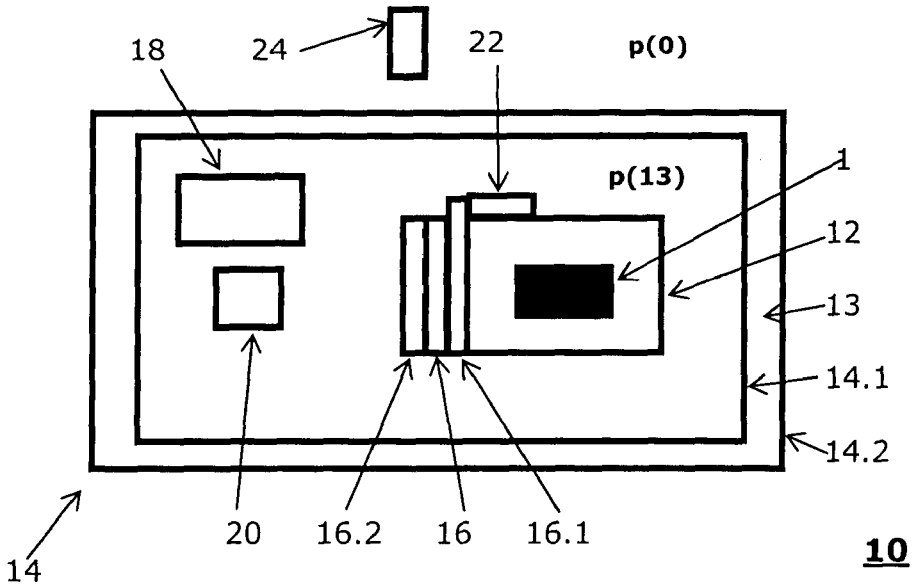
FIG. 1B shows a second exemplary embodiment of the present invention, having an externally situated controller, in a greatly simplified illustration.

FIGS. 1A and 1B show a first exemplary embodiment of a protection system 10 according to the present invention. Valuables 1, in the form of a bundle of banknotes here, are received and/or enclosed in an internal enclosure 12 (e.g., a currency cassette), and this internal enclosure 12 is received and/or enclosed in an external enclosure 14.

The internal enclosure 12 is an (ATM) cassette in the present case and is typically used for storing and transporting the valuables 1. The external enclosure 14 is closable to form a seal and is particularly intended for the purpose of receiving the internal enclosure 12 having the valuables 1 during a transport. In the present case, the external enclosure 14 is essentially rigid. For example, a typical hardside case or a receptacle like a hardside case may be used as the external enclosure 14. This is preferably a hardside case, which is preferably manufactured from a plastic material. Hardside cases made of thermoplastic material are especially preferred, preferably kydex® material.

A pressure chamber 13 is formed inside the external enclosure 14 when the latter is closed, in which a pressure p(13) exists, which differs depending on the situation and/or time, as explained below.

The pressure chamber 13 is essentially delimited by the internal enclosure 12 and the external enclosure 14. However, the external enclosure 14 may also be two-layered, the pressure chamber then being delimited by an external wall 14.1 and an internal wall 14.2 of the external enclosure.

The protection system 10 comprises a misuse protection device 16, which is used for the purpose of marking and/or devaluing the valuables 1 when an unauthorized manipulation of the protection system 10 is established. This marking or devaluing of the valuables 1 is performed, for example, in such a way that a staining or etching material is discharged under pressure onto the valuables 1, so that they are no longer exploitable and it thus becomes uninteresting to misuse and/or steal them. The misuse protection device 16 may also generate a visual or acoustic signal.

Means connected to the misuse protection device 16 are provided, to change the state of the misuse protection device 16 between an idle state, in which it is set as non-triggerable or less sensitive, and a triggerable state. The misuse protection device 16 may be put into its triggerable state in various ways. Influence on various constructive elements of the misuse protection device 16 may be taken in principle, in addition, the misuse protection device 16 may be put automatically or non-automatically into its triggerable state.

Furthermore, the protection system 10 comprises pressure-changing means 18, to generate a setpoint pressure p(13), which measurably deviates from the ambient pressure p(0), in the pressure chamber 13 when the external enclosure 14 is closed. These means 18 may be situated permanently in and/or on the external enclosure 14, as explained in greater detail below, or they may be temporarily situated outside the external enclosure 14.

A pressure sensor 20, which detects the particular pressure p(13) in the pressure chamber 13, is located in the pressure chamber 13. The pressure sensor 20 is used for the purpose of controlling initialization means 22, by which a triggering device 16.1 of the misuse protection device 16 may be initialized. This initialization is performed as soon as the pressure p(13) in the pres-sure chamber deviates from the setpoint pressure p(s) by more than a predefinable tolerance value Δp, but only when the misuse device 16 has previously been put into its triggerable state. The initialization means 22 may be inside the external enclosure 14 and remote controllable or programmable as shown in FIG. 1A. The initialization means 22 may also be situated outside the external enclosure 14, the connection to the triggering means 16.1 then being able to be wire-less. Initialization of the triggering means 16.1 results in triggering of the misuse protection device 16.

In the present exemplary embodiment, the protection system 10 also has control means 24. The control means 24 may be used for the purpose of selecting the particular required state of the misuse protection system 16, i.e., its idle state or its triggerable state. The control means 24 may also be used for the purpose of establishing the setpoint pressure p(s) and the tolerance pressure value Δp. In addition, the control means 24 may be used for the purpose of establishing the time at which the setpoint pressure p(s) is generated or determining the time span during which a manipulation of the external enclosure 14 puts the misuse protection device 16.1 into operation. However, the setpoint pressure p(s) is preferably built up completely autonomously, i.e., it may not be influenced. Like the initialization means 22, the control means 24 may also be inside the external enclosure 14 and remote controllable or programmable. The control means 24 may also be situated outside the external enclosure 14, having a wireless connection to the means 18 for generating the setpoint pressure p(s), to the pressure sensor 20, and to the triggering means 16.1. Simple protection systems according to the present invention work with control means like time switches which are permanently settable once. More complex control means are programmable, i.e., they may still be influenced even after beginning the method.

Figure 2A:
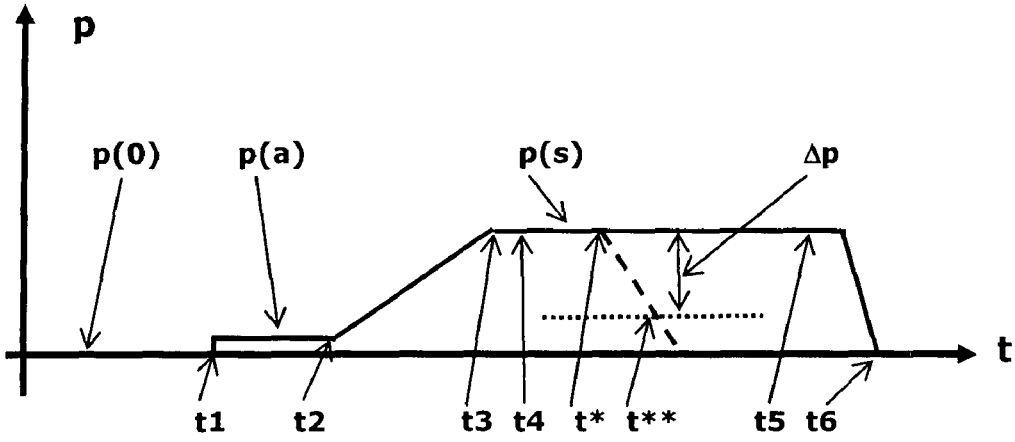
FIG. 2A shows the time curve of the pressure in the pressure chamber, in a first exemplary embodiment of the protection method or protection system according to the present invention.
Figure 2B:
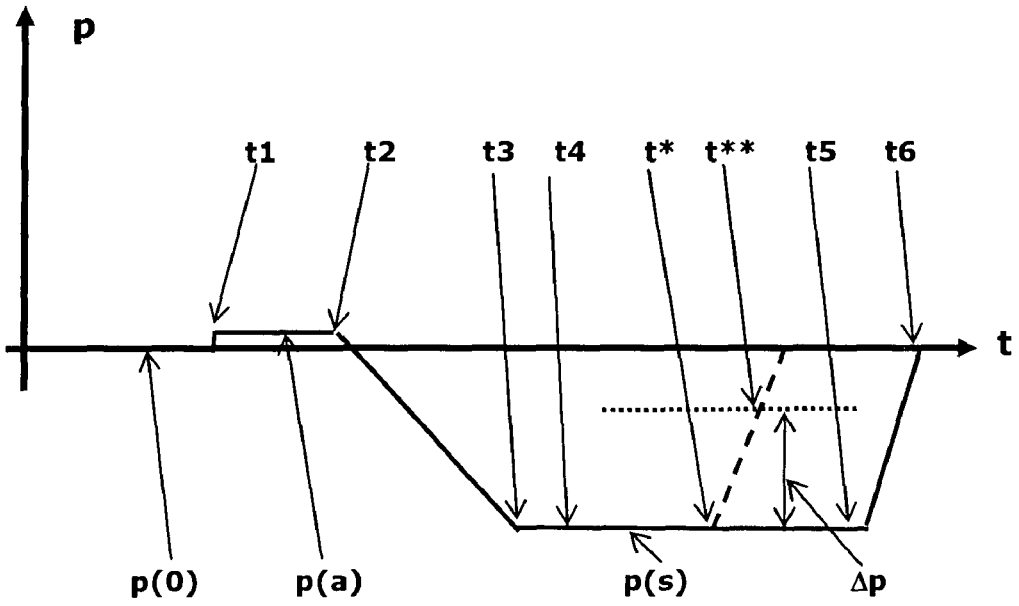
FIG. 2B shows the time curve of the pressure in the pressure chamber, in a second exemplary embodiment of the protection method or protection system according to the present invention.

FIGS. 2A and 2B show a possible pressure curve in the pressure chamber 13 as the method according to the present invention is performed. The running time t is plotted on the horizontal and the particular pressure p(13) existing in the pressure chamber 13 is plotted on the vertical in each of FIGS. 2A and 2B. The ambient pressure is identified by p(0). At time t1, the external enclosure 14 is closed, an initial pressure p(a), which is slightly higher than the ambient pressure p(0), possibly resulting, for example, if a cover of the external enclosure 14 is closed rapidly. At time t2, the means for generating the setpoint pressure p(s) are started (preferably autonomously), and at time t3, the setpoint pressure p(s) is reached. The protection system 10 is activated at a suitable time t4, i.e., for example, when a transport in danger of theft is imminent, i.e., the misuse protection device 16 is put into its triggerable state. However, the protection system 10 may also have been activated at another time. The setpoint pressure p(s) remains maintained beforehand or minimally approaches the ambient pressure p(0), if the external enclosure 14 is not completely sealed. The pressure p(13) is detected continuously or at short time intervals by the pressure sensor 20.

In the typical case, i.e., when no wrongful manipulation of the external enclosure 14 occurs, the pressure p(13) will first change again at time t6 to the ambient pressure p(0), after the external enclosure 14 has been opened by persons authorized for this purpose. Before such authorized opening of the external enclosure 14, the required measures are taken at time t5 to put the misuse protection device 16 back into its non-triggerable, i.e., idle or, if provided, its less sensitive state, to prevent undesired triggering of the misuse protection device 16 in this case. This pressure curve is illustrated in FIGS. 2A and 2B using solid lines.

In contrast, if there is an unauthorized manipulation of the external enclosure 14 at time t7*, which results in opening of the external enclosure 14, the pressure p(13) changes, starting from the setpoint pressure p(s), to the ambient pressure p(0). At time t7, i.e., as soon as the pressure p(13) deviates by the pressure differential Δp from the setpoint pressure p(s), the initialization means 22 will initialize the triggering means 16.1 and the latter will trigger the misuse protection device 16, because this is still in its triggerable state. This pressure curve is illustrated in FIGS. 2A and 2**B by dashed lines.

In order to prevent erroneous triggering of the misuse protection device 16, a signal may also solely be delivered in time t7*, which requires a confirmation within a specific warning time span to prevent erroneous triggering of the misuse protection device 16.

When establishing the particular setpoint pressure p(s), the ambient pressure, which is changeable depending on weather and elevation above sea level and depending on the ambient temperature, may also be taken into consideration. In this way, for example, the misuse protection device may be prevented from being started erroneously because the pressure p(13) has risen as a result of a high ambient temperature, thus an increased temperature in the external enclosure, and therefore an increased pressure in the external enclosure 14.

A changeable setpoint pressure p(s) prevents unauthorized individuals from preventing the initialization of the misuse protection device 16 by corresponding measures, such as opening the external enclosure 14 in a pressure chamber.

Figure 3A:
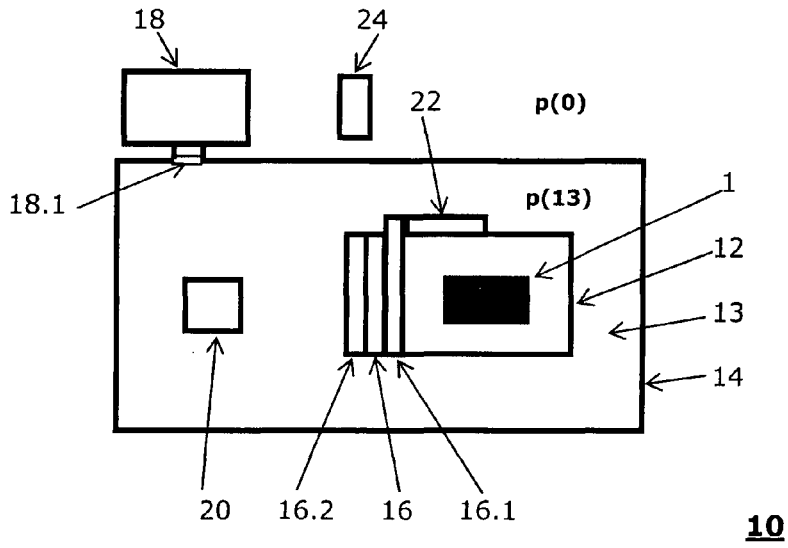
FIG. 3A shows a protection system according to the present invention, having an internal pump for generating the setpoint pressure.

FIG. 3A shows a protection system 10 according to the present invention, in which the pressure-changing means 18 for generating the setpoint pressure p(s) comprise a pump. A tightly closable passage 18.1 (for example, provided with a suitable valve), is provided in the external enclosure 14, so that if the passage is not closed, the pressure chamber 13 may communicate with the surroundings.

An integrated pump, which is permanently connected to the protection device 10, may be used as the pump. Such an integrated pump may be an external pump, which is situated inside the external enclosure 14 as shown in FIG. 3A, or an internal pump, which is situated outside the external enclosure 14. A non-integrated pump may also be used, which is only temporarily connected to the remaining components of the protection system 10. Integrated external pumps and non-integrated pumps allow the power supply for generating the set-point pressure to be produced in a constructively simple way which does not have limited energy.

In order to avoid a passage 18.1 in the external enclosure 14, which may represent a weak point, if a pump is used as the pressure-changing means 18, the configuration described in the following may be selected. A pressure container is provided inside the pressure chamber 13, which communicates with the pressure chamber 13 via an opening having a check valve. When the pump is turned on, the pressure p(13) in the pressure chamber is reduced and the pressure in the pressure container is increased.

Figure 3B:
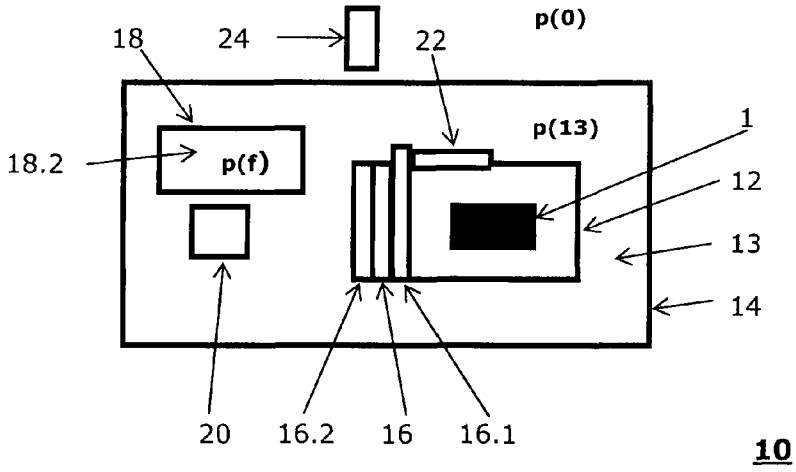
FIG. 3B shows a protection system according to the present invention, having an external pump for generating the setpoint pressure.

FIG. 3B shows a further embodiment of the protection system 10 according to the present invention, in which a physical procedure is started to generate the setpoint pressure p(s), but not with the aid of a pump. The setpoint pressure p(s) generated in this way is above the ambient pressure p(0), corresponding to FIG. 2A. A pressure container is essentially provided as the pressure-changing means 18. A fluid 18.2 is contained in the pressure container, which is under a fluid pressure p(f), which deviates more from the ambient pressure p(0) than the setpoint pressure p(s) to be generated. After the internal enclosure 12 having the valuables 1 is enclosed in the external enclosure 14, the pressure container is opened, and the fluid 18.2 contained therein expands as a gas into the pressure chamber 13, due to which the pressure p(13) rises to the setpoint pressure p(s).

Figure 3C:
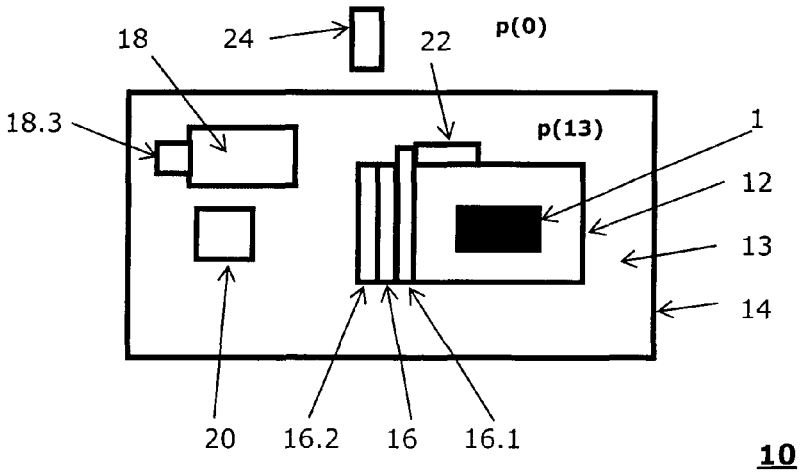
FIG. 3C shows still a further embodiment of the protection system according to the present invention.

FIG. 3C shows still a further embodiment of the protection system 10 according to the present invention, in which a chemical procedure is started to generate the setpoint pressure p(s). A setpoint pressure p(s) is typically generated for this purpose, which is above the ambient pressure p(0), corresponding to FIG. 2A, in that the chemical reaction results in a pressure increase in the pressure chamber 13, as is the case in particular in the event of pyrotechnic procedures. However, a chemical reaction which results in a pressure reduction in the pressure chamber 13 may also be performed, so that the setpoint pressure p(s) is below the ambient pressure p(0), corresponding to FIG. 2B. A suitable quantity of an explosive material having an ignition system 18.3, which is either preprogrammable or externally controllable, is situated in the pressure chamber 13 as the pressure changing means 18 for performing a pyrotechnic reaction. The explosive material is ignited at a suitable time, after the internal enclosure 12 having the valuables 1 has been enclosed in the external enclosure 14.

As already noted, the use of the term "enclosing" does not necessarily indicate a closing procedure using a type of lock, but rather introducing and fastening.

Predefining a partial vacuum has especially proven itself, because the entire system reacts much more sensitively to manipulations in case of a partial vacuum. The pressure change in case of a manipulation is very much clearer if a partial vacuum is predefined.

In a currently preferred embodiment of the present invention, a double-walled container is used, which has an internal enclosure enclosed in an external enclosure. This container is manufactured ready for this purpose and the pressure chamber resulting between internal enclosure and external enclosure is impinged by excess pressure or partial vacuum (preferred variation) and hermetically sealed.

Embodiments which operate using a special gas are preferred. Sensors may be used which detect not only changes of the pressure, but also the presence, or the absence, of this special gas.

What is claimed is:

1. A protection method for protecting valuables, the valuables being enclosed in an internal enclosure, the internal enclosure being enclosed in an external enclosure, and a misuse protection device for the valuables being triggered in the event of an unauthorized manipulation on the external enclosure, the method comprising the steps of:

enclosing the internal enclosure in the external enclosure, and forming a tightly sealed pressure chamber impinged by an initial pressure in the external enclosure, defining a setpoint pressure that deviates from the ambient pressure;

using pressure-changing means, generating the setpoint pressure in the pressure chamber, at least one of (a) changing the setpoint pressure in the event of a change of the ambient pressure and (b) changing the setpoint pressure in the event of a change of the ambient temperature, and monitoring the pressure in the pressure chamber using a pressure sensor, wherein a triggering device is controlled by the pressure sensor and triggers the misuse protection device when the pressure in the pressure chamber deviates from the setpoint pressure by more than a tolerance pressure value.

2. The protection method according to claim 1, wherein the misuse protection device is put into a triggerable or less sensitive state when the pressure in the pressure chamber has reached the setpoint pressure.

3. The protection method according to claim 1, wherein the setpoint pressure is generated with the aid of a pump.

4. The protection method according to claim 1, wherein the setpoint pressure is generated with the aid of a chronologically controllable physical procedure executed in the interior of the pressure chamber.

5. The protection method according to claim 1, wherein the setpoint pressure is generated with the aid of a chronologically controllable chemical procedure executed in the interior of the pressure chamber.

6. The protection method according to claim 4, wherein the chronologically controllable physical procedure is an expansion of a fluid in gaseous form from a pressure container.

7. The protection method according to claim 5, wherein the chronologically controllable chemical procedure is a pyrotechnic procedure.

8. The protection method according to claim 1, wherein the setpoint pressure deviates from the ambient pressure by a predetermined value, and the changing step includes changing the setpoint pressure in the event of said change so that the setpoint pressure deviates from the changed ambient pressure by said predetermined value.

9. The protection method according to claim 1, wherein the changing step comprises changing the setpoint pressure in the event of a change of the ambient pressure.

10. The protection method according to claim 1, wherein the changing step comprises changing the setpoint pressure in the event of a change of the ambient temperature.

11. The protection method according to Claim 9, further comprising the step of changing the setpoint pressure in the event of a change of the ambient temperature.

12. A protection system for protecting valuables, comprising:

an internal enclosure for enclosing the valuables, an external enclosure for enclosing the internal enclosure, wherein the external enclosure is closable to form a seal and a pressure chamber impinged by an initial pressure may thus be generated in the external enclosure, a misuse protection device for the valuables, a triggering device for triggering the misuse protection device in the event of an unauthorized manipulation of the external enclosure, pressure-changing means, to generate a setpoint pressure, which deviates from the ambient pressure, in the pressure chamber when the external enclosure is closed to form a seal, a pressure sensor situated to detect the pressure in the pressure chamber, initialization means controllable by the pressure sensor, by which the triggering device may be initialized and thus the misuse protection device may be triggered when the pressure deviates from the setpoint pressure by more than a tolerance pressure value, and control means to control the setpoint pressure and at least one of (a) adapted to change the setpoint pressure in the event of a change of the ambient pressure, wherein the control means changes the setpoint pressure in the event of a change of the ambient pressure; and (b) adapted to change the setpoint pressure in the event of a change of the ambient temperature, wherein the control means changes the setpoint pressure in the event of a change of the ambient temperature.

13. The protection system according to claim 12, further comprising means to change the state of the misuse protection device between an idle state and a triggerable state while the setpoint pressure exists in the pressure chamber.

14. The protection system according to claim 12, wherein the internal enclosure is a cassette.

15. The protection system according to claim 12, wherein the misuse protection device includes a device situated in the internal enclosure for devaluing the valuables.

16. The protection system according to claim 12, wherein the external enclosure is rigid.

17. The protection system according to claim 12, wherein the external enclosure has an opening, which is closable to form a seal, via which the pressure chamber may be connected to the surroundings, and the means for generating the setpoint pressure in the pressure chamber includes a pump.

18. The protection system according to claim 17, wherein the pump is situated outside the external enclosure.

19. The protection system according to claim 17, wherein the pump is attached inside the external enclosure and is controllable from outside the external enclosure.

20. The protection system according to claim 12, wherein the setpoint pressure in the pressure chamber may be generated by means selected from at least one of physical means and chemical means.

21. The protection system according to claim 20, wherein the means for generating the setpoint pressure in the pressure chamber includes a pressure container situated in the external enclosure and having a fluid, whose fluid pressure deviates more strongly from the ambient pressure than the setpoint pressure, and wherein the pressure container is closed upon the closure of the external enclosure, and has a control device to generate a connection of the pressure container to the pressure chamber in such a way that the fluid expands like a gas into the pressure chamber and increases the pressure in the pressure chamber to the setpoint pressure.

22. The protection system according to claim 20, wherein the means for generating the setpoint pressure in the pressure chamber includes an explosive material, which is situated in the external enclosure, and which is ignited using a control device, the pressure in the pressure chamber being increased to the setpoint pressure by the ignition.

23. The protection system according to claim 12, wherein the external enclosure has an external wall and an internal wall, and the pressure chamber is delimited by the external wall and the internal wall.

24. The protection system according to claim 14, wherein the internal enclosure includes the misuse protection device.

25. The protection system according to claim 14, wherein the internal enclosure is a currency cassette.

26. The protection system according to claim 16, wherein the external enclosure is a hardside case.

27. The protection system according to claim 12, wherein the setpoint pressure deviates from the ambient pressure by a predetermined value, and the control means is adapted to change the setpoint pressure in the event of said change so that the setpoint pressure deviates from the changed ambient pressure by said predetermined value.

28. The protection system according to claim 12, wherein the control means is adapted to change the setpoint pressure in the event of a change of the ambient pressure and changes the setpoint pressure in the event of a change of the ambient pressure.

29. The protection system according to claim 12, wherein the control means is adapted to change the setpoint pressure in the event of a change of the ambient temperature and changes the setpoint pressure in the event of a change of the ambient temperature.

30. The protection system according to Claim 28, wherein the control means is further adapted to change the setpoint pressure in the event of a change of the ambient temperature and changes the setpoint pressure in the event of a change of the ambient temperature.

31. A protection method for protecting valuables, the valuables being enclosed in an internal enclosure, the internal enclosure being enclosed in an external enclosure, and a misuse protection device for the valuables being triggered in the event of an unauthorized manipulation on the external enclosure, the method comprising the steps of:

enclosing the internal enclosure in the external enclosure, and forming a tightly sealed pressure chamber impinged by an initial pressure in the external enclosure, defining a setpoint pressure that deviates from the ambient pressure;

using pressure-changing means, generating the setpoint pressure in the pressure chamber, changing the setpoint pressure in the event of a change of the ambient temperature and monitoring the pressure in the pressure chamber using a pressure sensor, wherein a triggering device is controlled by the pressure sensor and triggers the misuse protection device when the pressure in the pressure chamber deviates from the setpoint pressure by more than a tolerance pressure value.

32. A protection system for protecting valuables, comprising:

an internal enclosure for enclosing the valuables, an external enclosure for enclosing the internal enclosure, wherein the external enclosure is closable to form a seal and a pressure chamber impinged by an initial pressure may thus be generated in the external enclosure, a misuse protection device for the valuables, a triggering device for triggering the misuse protection device in the event of an unauthorized manipulation of the external enclosure, pressure-changing means, to generate a setpoint pressure, which deviates from the ambient pressure, in the pressure chamber when the external enclosure is closed to form a seal, a pressure sensor situated to detect the pressure in the pressure chamber, initialization means controllable by the pressure sensor, by which the triggering device may be initialized and thus the misuse protection device may be triggered when the pressure deviates from the setpoint pressure by more than a tolerance pressure value, and control means to control the setpoint pressure and adapted to change the setpoint pressure in the event of a change of the ambient temperature, wherein the control means changes the setpoint pressure in the event of a change of the ambient temperature.

* * * * *